US008807039B2

(12) United States Patent
Carpenter et al.

(10) Patent No.: US 8,807,039 B2
(45) Date of Patent: Aug. 19, 2014

(54) BALLISTIC SEALING, COMPONENT RETENTION, AND PROJECTILE LAUNCH CONTROL FOR AN AMMUNITION CARTRIDGE ASSEMBLY

(75) Inventors: David A. Carpenter, Clarksville, MD (US); William Henry Engel, IV, Cockeysville, MD (US); Brandon S. Recchia, Parkville, MD (US); Paul Andrew Shipley, Millers, MD (US)

(73) Assignee: AAI Corporation, Hunt Valley, MD (US)

( * ) Notice: Subject to any disclaimer, the term of this patent is extended or adjusted under 35 U.S.C. 154(b) by 0 days.

(21) Appl. No.: 13/534,246

(22) Filed: Jun. 27, 2012

(65) Prior Publication Data

US 2014/0000471 A1 Jan. 2, 2014

(51) Int. Cl.
*F42B 5/045* (2006.01)

(52) U.S. Cl.
USPC ..... 102/434

(58) Field of Classification Search
USPC ..... 102/434, 466, 467, 469, 433
See application file for complete search history.

(56) References Cited

U.S. PATENT DOCUMENTS

| | | | | | |
|---|---|---|---|---|---|
| 3,009,394 | A * | 11/1961 | Kamp et al. | ..... | 89/35.01 |
| 4,140,058 | A * | 2/1979 | Ballreich et al. | ..... | 102/466 |
| 4,192,233 | A * | 3/1980 | Dumortier | ..... | 102/466 |
| 4,738,202 | A * | 4/1988 | Hebert | ..... | 102/467 |
| 4,770,098 | A * | 9/1988 | Stoner | ..... | 102/434 |
| 4,846,068 | A * | 7/1989 | Zedrosser | ..... | 102/430 |
| 4,848,237 | A * | 7/1989 | Zedrosser | ..... | 102/471 |
| 5,265,540 | A * | 11/1993 | Ducros et al. | ..... | 102/434 |
| 5,421,263 | A * | 6/1995 | Ruohonen | ..... | 102/435 |
| 5,467,716 | A * | 11/1995 | Boual | ..... | 102/434 |
| 6,564,719 | B2 | 5/2003 | Saxby | | |
| 7,021,219 | B1 | 4/2006 | Dindl | | |
| 7,225,741 | B2 | 6/2007 | Huffman | | |
| 2005/0257712 | A1 * | 11/2005 | Husseini et al. | ..... | 102/466 |
| 2008/0047457 | A1 | 2/2008 | Riess et al. | | |
| 2011/0079164 | A1 | 4/2011 | Broden et al. | | |
| 2012/0085259 | A1 | 4/2012 | Cronemberger | | |

* cited by examiner

*Primary Examiner* — Jonathan C Weber

(74) *Attorney, Agent, or Firm* — Venable LLP; Jeffri A. Kaminski; Todd R. Farnsworth

(57) ABSTRACT

A telescoped ammunition cartridge assembly including a case having a front end and a base end positioned along a longitudinal axis. A projectile is positioned along the longitudinal axis towards the front end of the case. An endcap is coupled to the front end of the case and is adapted to retain the projectile entirely within the case. A primer is positioned along the longitudinal axis towards the base end of the case. A primer support is coupled to the base end of the case and is adapted to support the primer within the case. The cartridge assembly includes at least one obturating lip seal to seal at least one of the endcap or the primer support to the case.

20 Claims, 6 Drawing Sheets

BALLISTIC SEALING, COMPONENT RETENTION, AND PROJECTILE LAUNCH CONTROL FOR AN AMMUNITION CARTRIDGE ASSEMBLY

CROSS-REFERENCE TO RELATED APPLICATIONS

This invention was made using U.S. Government support under Grant No. contracts W15QKN-04-C-1085 and W15QKN-08-C-047. The U.S. Government has certain rights in this invention.

BACKGROUND

Embodiments of the present invention relate generally to new and useful improvements in ammunition cartridge assembly, and more particularly to ballistic sealing, component retention, and projectile launch control for an ammunition cartridge assembly. The present invention may also relate to a cased telescoped ammunition cartridge assembly.

Cased telescoped ammunition has been used successfully in small, medium, and large caliber applications. See, for example, U.S. Pat. Nos. 4,738,202 and 4,770,098, which disclose telescoped ammunition rounds utilizing nonstrategic materials. Small caliber is generally defined as less than 0.50 caliber, medium caliber is generally defined as between 0.50 caliber and 60 millimeters, and large caliber is generally defined as 60 millimeters and larger.

However, maintaining an effective seal remains an issue in all applications of cased telescoped ammunition. Generally, in conventional cartridge arrangements, component sealing is provided via press fits at the primer/case interface and the projectile/case interface. Such sealing under ballistic pressure at the case mouth is accomplished via expansion of the case against the chamber wall. The interfaces of a cased telescoped cartridge arrangement using a polymer case are substantially different in geometry and material characteristics, thus, rendering the conventional press fit sealing approaches ineffective.

Likewise, in a conventional cartridge assembly, component retention is provided via a press fits at the primer/case interface and the projectile/case interface. However, press fits are unsuitable for cased telescoped ammunition because the lightweight polymer materials used in cased telescoped ammunition will deform and degrade over the cartridge lifetime, as a result of residual stresses introduced by the press fits.

Furthermore, in conventional cartridge arrangements, the projectile protrudes from the case. The alignment of the protruding projectile is generally controlled via a case mouth and crimp arrangement. Since minimal projectile translation occurs before the projectile enters the barrel, shot start force is determined by the case crimp and barrel forcing cone profile. Neither of these approaches are applicable to a telescoped cartridge, since the projectile is initially seated within the cartridge.

In short, there exists a need in the art for a cased telescoped ammunition cartridge assembly that includes improved ballistic sealing, component retention, and projectile launch control.

SUMMARY

According to an embodiment, a telescoped ammunition cartridge assembly, comprises a case having a front end and a base end positioned along a longitudinal axis; a projectile positioned along the longitudinal axis towards the front end of the case; an endcap coupled to the front end of the case and adapted to retain the projectile entirely within the case; a primer positioned along the longitudinal axis towards the base end of the case; a primer support coupled to the base end of the case and adapted to support the primer within the case; and at least one obturating lip seal to seal at least one of the endcap or the primer support to the case.

This summary is provided merely to introduce certain concepts and not to identify any key or essential features of the claimed subject matter. Further features and advantages of embodiments of the invention, as well as the structure and operation of various embodiments of the invention, are described in detail below with reference to the accompanying drawings.

BRIEF DESCRIPTION OF THE DRAWINGS

The foregoing and other features and advantages of embodiments of the invention will be apparent from the following, more particular description of embodiments of the invention, as illustrated in the accompanying drawings wherein like reference numbers generally indicate identical, functionally similar, and/or structurally similar elements. Unless otherwise indicated, the accompanying drawing figures are not to scale.

DETAILED DESCRIPTION

Various embodiments of the invention are discussed herein. While specific embodiments are discussed, specific terminology is employed for the sake of clarity. However, the invention is not intended to be limited to the specific terminology so selected and it should be understood that this is done for illustration purposes only. A person skilled in the relevant art will recognize that other components and configurations can be used without parting from the spirit and scope of the invention. Each specific element includes all technical equivalents that operate in a similar manner to accomplish a similar purpose.

Figure 1:
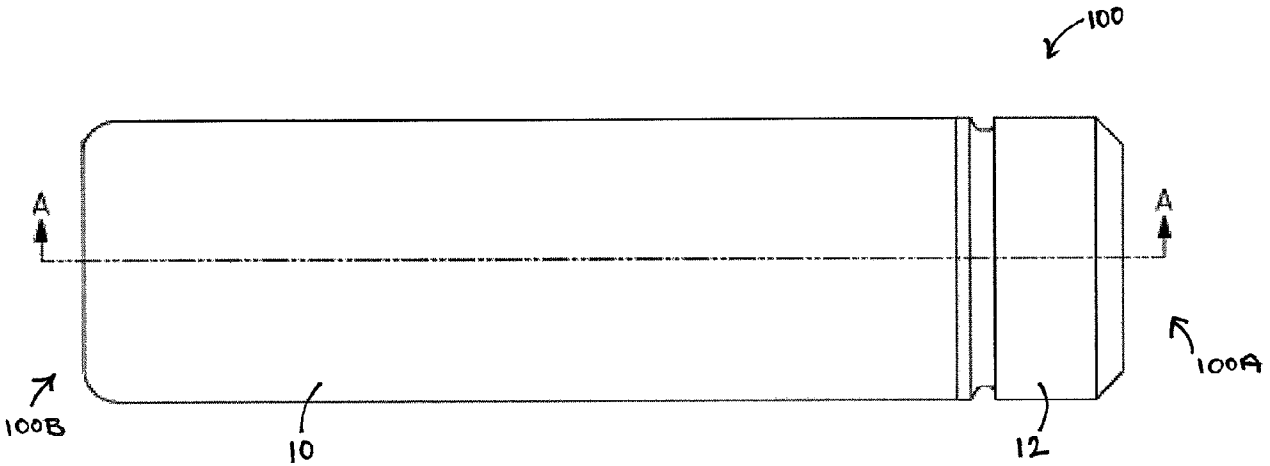
FIG. 1 depicts a top view of an ammunition cartridge, according to an embodiment of the present invention.

Referring to the drawings, there is shown in FIG. 1 a top view of an ammunition cartridge 100, according to an embodiment of the present invention. The ammunition cartridge 100 includes a cartridge case 10, also simply referred to as a case. The ammunition cartridge 100 may include a front end 100A and a base end 100B along a longitudinal axis X (see FIG. 4). An endcap 12 may be insertable into the case 10 at the front end 100A of the cartridge, and a primer 16 may be insertable into the primer support 18, which then may be insertable into the case 10 at the base end 100B of the cartridge (see FIG. 3).

The ammunition cartridge 100, also referred to as a cartridge or a round, may package a projectile 20, propellant 22 (see FIG. 4), and the primer 16 into a single unit within the case 10 that is precisely made to fit within the firing chamber of a firearm (not shown). The primer 16 may be a small charge of an impact-sensitive chemical mixture that can be located at the center of the base end 100B of the cartridge 100 along longitudinal axis X (called "centerfire ammunition"), or in other embodiments, inside a rim (called "rimfire ammunition").

The case 10 may be a polymer casing that extends from the base end 100B, or base, of the cartridge 100 forward. The primer 16 may be attached to the primer support 18 which may be attached to the case 10 at the base end 100B, and the endcap 12 attached to the front end 100A, also called the front, of the cartridge 100. The case 10, for example, may be made of a suitable polymer material, to remain moldable and to survive extreme temperature conditions. The case 10 may be filled with propellant 22 (see FIG. 4) when assembled. The propellant charge weight may be varied to comply with the ballistic requirements of the firearm. Similarly, the use of a polymer material for the case 10 may reduce cartridge 100 weight versus conventional materials such as steel or brass.

Figure 2:
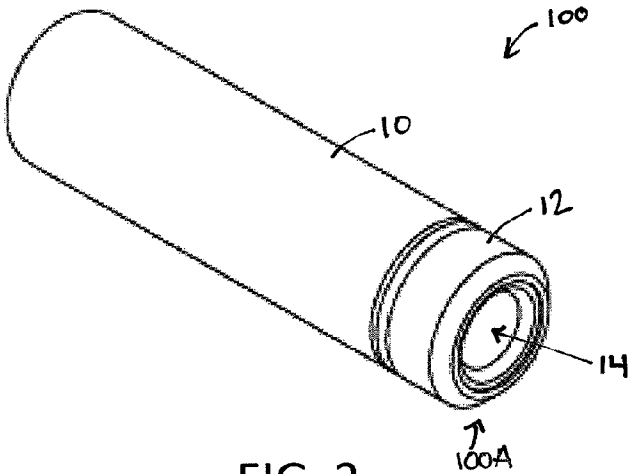
FIG. 2 depicts a perspective view of the ammunition cartridge of FIG. 1.

FIG. 2 depicts a perspective view of the ammunition cartridge 100 of FIG. 1, including the endcap 12 inserted into the case 10 at the front end 100A of cartridge 100. The endcap 12 may include a through-hole 14, through which the projectile 20 (see FIG. 4) may exit the cartridge 100 during use.

Figure 3:
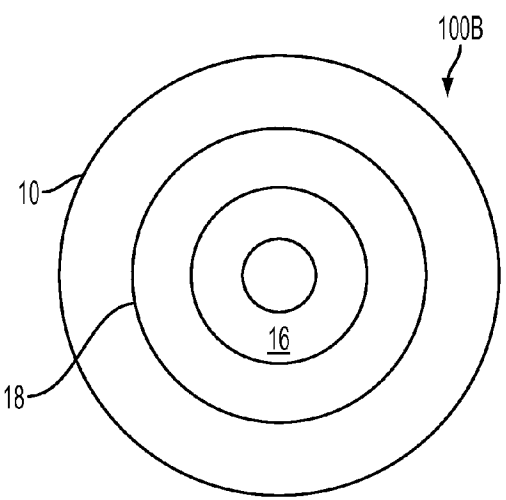
FIG. 3 depicts a base view of the ammunition cartridge of FIG. 1.

FIG. 3 depicts a base view of the ammunition cartridge 100 of FIG. 1. The ammunition cartridge 100 may include a primer support 18 that may be fitted between the primer 16 and the case 10 at the base end 100B. The primer 16, for example, may comprise a standard metallic percussion activated primer, and may be utilized at the base end 100B, or base, of the ammunition cartridge 100 to initiate propellant combustion. The primer support 18, for example, may be a metallic primer support, and may serve both to support the primer anvil during the initiation process and transfer the percussion loads introduced by the firing pin to the base end 100B of the cartridge 100.

Figure 4:
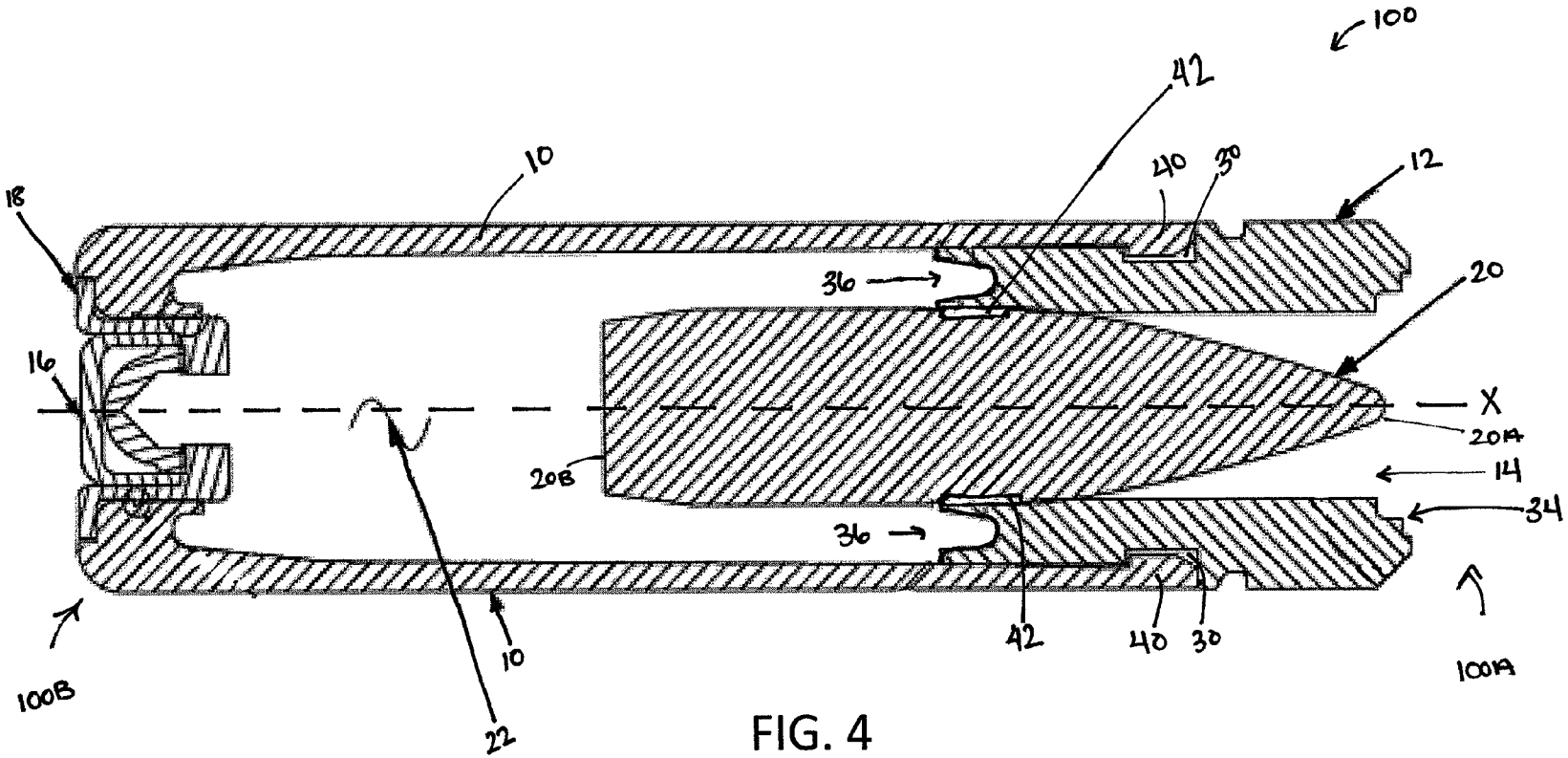
FIG. 4 depicts a cross-sectional view of the ammunition cartridge along section A-A of FIG. 1.

FIG. 4 depicts a cross-sectional view of the ammunition cartridge 10 along section A-A of FIG. 1. In this embodiment, the ammunition cartridge 100 may comprise a cased telescoped ammunition cartridge, that may include a projectile 20, a case 10, an endcap 12, and a primer 16. The endcap 12 may be adapted to support the projectile 20 within the case 10. A front end 20A of the projectile 20 may be aligned to sit flush with the front end 100A of the cartridge 100, thus, resting entirely within the cartridge 100. A base end 20B of the projectile 20 may be positioned within the case 10, and may be immersed in the propellant 22 contained within the case prior to use.

During use, the cartridge case 10 may seal a firing chamber in all directions except for the through-hole 14 in the endcap 12. A firing pin (not shown) may strike the primer 16 to ignite it, the primer compound may deflagrate and begin to rapidly burn. A jet of burning gas from the primer 16 may ignite the propellant 22. Gases from the burning propellant 22 may pressurize and expand the case 10 to seal it against the chamber wall of the firearm (not shown). These propellant gases may push on the base end 20B of the projectile 20, and may cause the projectile 20 to move in the path of least resistance, i.e. down the through-hole 14 of the endcap 12 and through the barrel of the firearm (not shown). After the projectile 20 leaves the barrel, the chamber pressure may drop to atmospheric pressure. The case 10, which may have been elastically expanded by chamber pressure, may contract slightly. This may ease removal of the ammunition cartridge 100 from the chamber.

According to one embodiment, interfaces of the case 10 at the primer support 18 and endcap 12 may provide sealing and retention. For example, obturating lip seals, or other sealing mechanisms, may be used to seal the primer support 18 to the case 10, and to seal the endcap 12 to the case 10. These sealing interfaces may prevent pressure from escaping between the components. Ultrasonic welding may be further used to attach the case 10 to the primer support 18, and the projectile 20 to the endcap 12. This attachment interface may retain the components in position before and during use.

The endcap 12, which may also be a lightweight polymer material, may support and retain the embedded projectile 20 in a "telescoped" arrangement such that the projectile 20 does not protrude beyond the forward face of the endcap 12. As discussed above, when the primer 16 is initiated via a weapon firing pin, combustion may then be transferred to the propellant 20. As pressure builds within the cartridge 100, the projectile 20 may move forward out of the cartridge 100 in a direction F (see FIG. 9) and enter the barrel of the firearm (not shown). The combustion may continue, propelling the projectile 20 down the barrel and out the muzzle (not shown). Cartridge assembly component retention, sealing, and launch control are required throughout the ballistic cycle.

Figure 5:
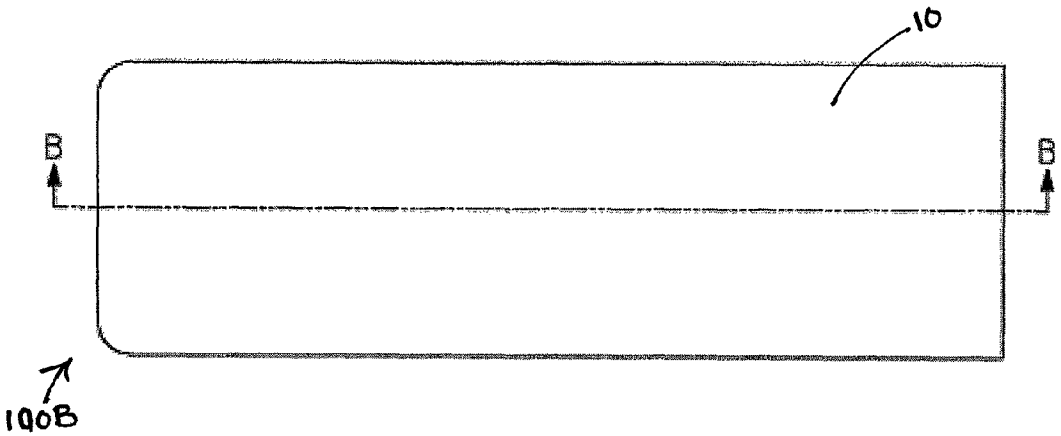
FIG. 5 depicts a top view of a base end of the ammunition cartridge, according to an embodiment of the present invention.
Figure 6:
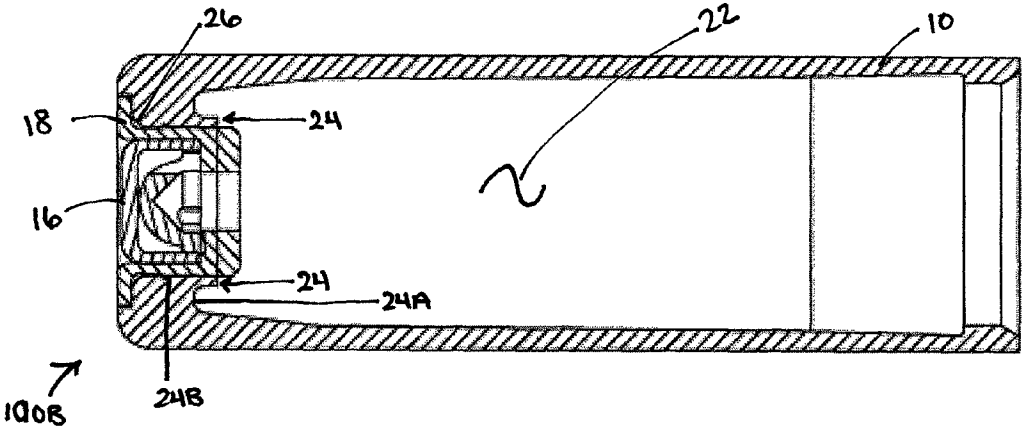
FIG. 6 depicts a cross-sectional view of the base end of the ammunition cartridge along section B-B of FIG. 5.

FIG. 5 depicts a top view of a base end 100B of the ammunition cartridge 100, including cartridge case 10, according to an embodiment of the present invention. FIG. 6 depicts a cross-sectional view of the base end 100B of the ammunition cartridge 100 along section B-B of FIG. 5. According to one embodiment, a metallic primer support 18 may be located at the base end 100B, or base, of the cartridge 100. The primer support 18 may contain a standard percussion primer 16 and an interface with the cartridge case 10. The primer 16 may include an anvil supported by the primer support 18. Sealing between the primer support 18 and the cartridge case 10, and retention of the primer support 18 before, during and after firing, may be accomplished via the use of an obturating lip seal 24 in the cartridge case 10 and/or ultrasonic welding. The obturating lip seal 24 may have a larger exterior surface area 24A, i.e. the area that is exposed to the propellant gasses 22 in the case 10, than an interior surface area 24B, i.e. the area in contact with the primer support 18. For example, the exterior surface area 24A of the obturating lip seal 24 may have a curved or C-shaped configuration towards the interior of the casing 10, whereas the interior surface area 24B may have a straight configuration against the primer support 18. The action of propellant gasses 22 on the larger net exterior surface area 24A may provide a clamping action to seal the interface and prevent gas leakage.

Figure 7:
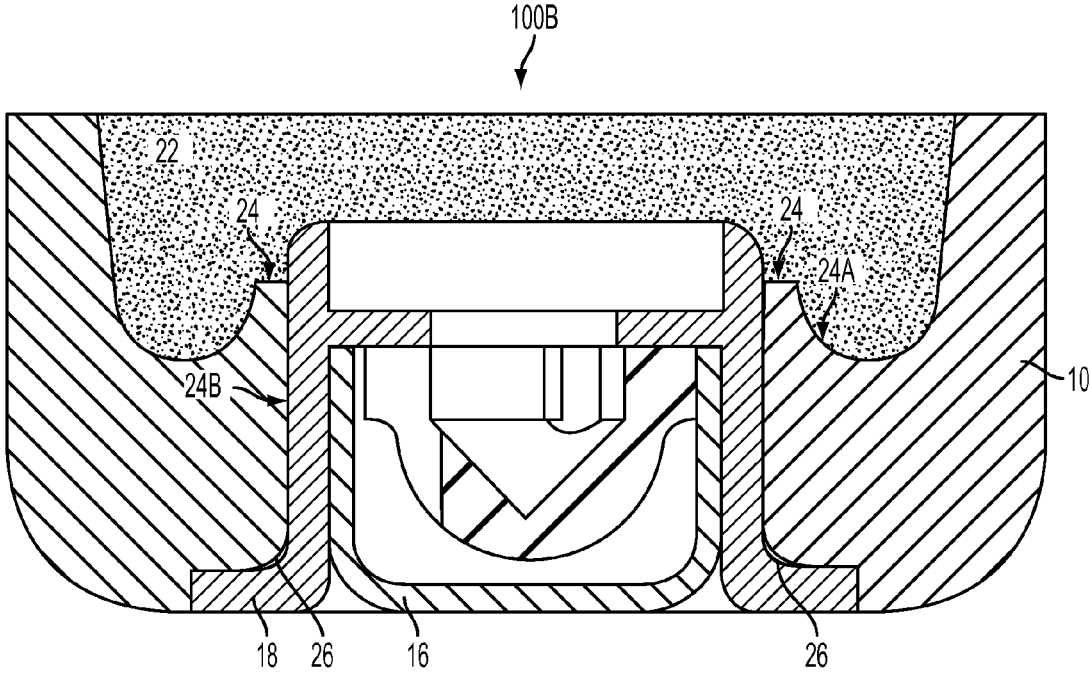
FIG. 7 depicts a detailed cross-sectional view of the base end of the ammunition cartridge of FIG. 6.

FIG. 7 depicts a detailed cross-sectional view of the base end 100B of the ammunition cartridge 100 of FIG. 6. As shown, a relief volume 26 may be provided under and behind the obturating lip seal 24 such that any initial gas leakage may be exhausted to atmospheric pressure. This may allow a pressure differential to be maintained across the obturating lip seal 24, or obturator, that may create a progressive sealing action that prevents further leakage.

According to one embodiment, the obturating lip seal 24 may be machined into a molded case 10. According to another embodiment, the obturating lip seal 24 may be incorporated into a machined case 10.

According to a further embodiment, ultrasonically welding the joint of the obturating lip seal 24 may enable a conformal fit between the primer support 18 and the polymer case 10 without creating residual stresses in the polymer part. It may also provide environmental sealing to prevent intrusion of contamination from the exterior environment.

Figure 8:
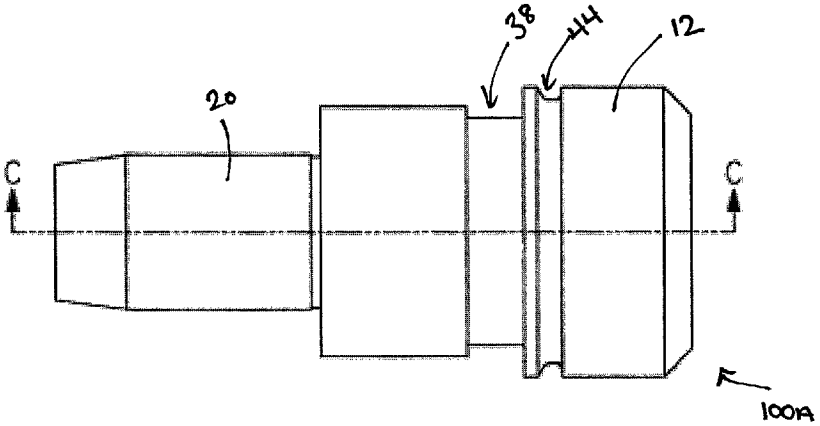
FIG. 8 depicts a top view of a front end of the ammunition cartridge, according to an embodiment of the present invention.

FIG. 8 depicts a top view of a front end 100A of the ammunition cartridge 100, according to an embodiment of the present invention. This view, provided without case 10, depicts the projectile 20 supported within the endcap 12.

Figure 9:
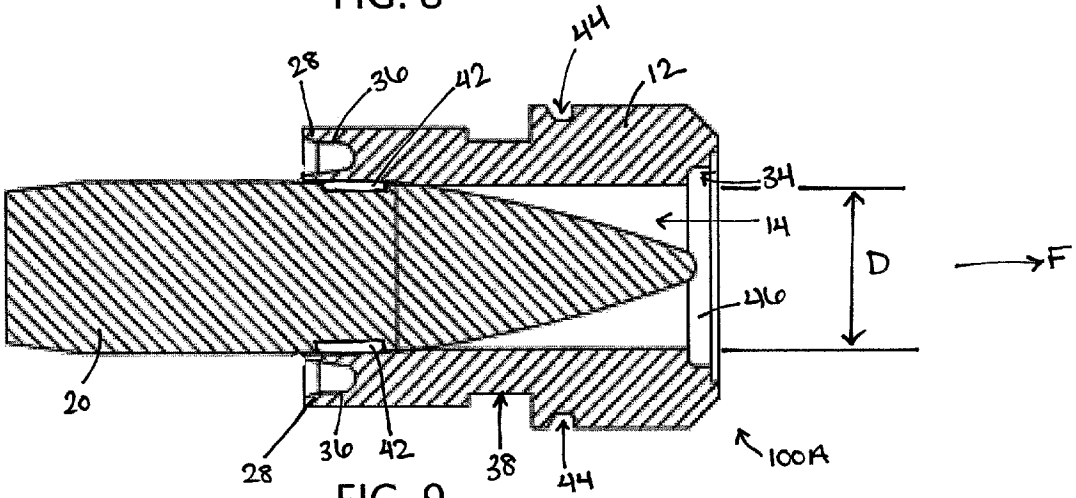
FIG. 9 depicts a cross-sectional view of the front end of the ammunition cartridge along section C-C of FIG. 8.
Figure 10:
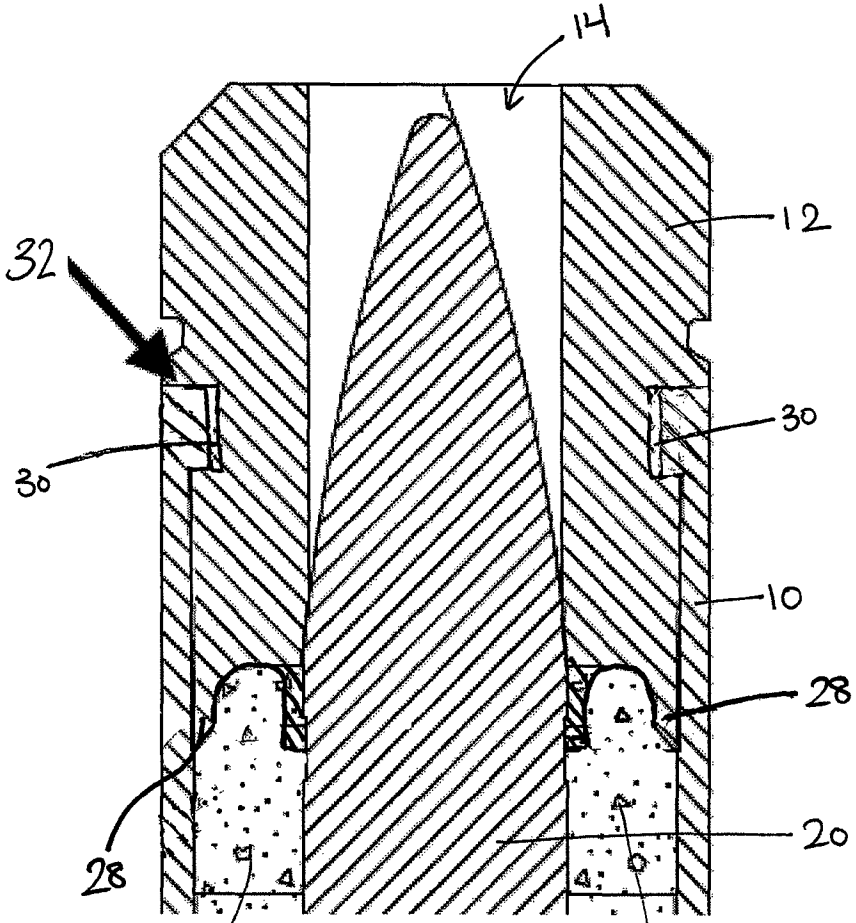
FIG. 10 depicts a detailed cross-sectional view of the front end of the ammunition cartridge of FIG. 9.

FIG. 9 depicts a cross-sectional view of the front end 100A of the ammunition cartridge 100 along section C-C of FIG. 8, and FIG. 10 depicts a detailed cross-sectional view of the front end 100A of the ammunition cartridge 100 of FIG. 9. In these embodiments, a polymer endcap 12, containing the projectile 20, may be attached to the cartridge case 10. The endcap 12 may be machine or mold fabricated and may be, for example, made of suitable polymer material. Another obturating lip seal 28 may be used to seal the interface between the case 10 and the endcap 12. The obturating lip seal 28 may be located on the endcap 12, and may provide an interference fit with the cartridge case 10 upon assembly.

According to one embodiment, the obturating lip seal 28 may provide both a sealing and retention function. The obturating lip seal 28 may function in the same manner as described above for the obturating lip seal 24 of the primer support 18. Ultrasonic welding may be used to attach the case 10 to the endcap 12 without creating residual stresses, again as described with regard to the obturating lip seal 24 of the primer support 18.

According to another embodiment, the interface geometry between the endcap 12 and the case 10 need not provide a differential surface area function, as may be necessary with obturating lip seal 24 of the primer support 18. Instead, the system may rely on the interference fit with the case 10 to facilitate initial sealing, coupled with an enlarged relief volume 30 (see FIG. 10) that ensures rapid sealing once ballistic pressure is applied. Additionally, making the obturating lip much less stiff than the case it is sealing against allows the obturating lip to maintain contact with the case under pressurization. The joint arrangement of the present embodiment maintains a seal regardless of differential motion of the joint due to cartridge 100 expansion and stretching during the ballistic cycle. A snap fit 32, or other attachment type, may be further utilized to retain the endcap 12 on the case 10.

According to a further embodiment, the projectile 20 must first traverse the length of the endcap 12 within the cartridge 100 before entering the weapon barrel. During this transition it may be critical that projectile movement occur in a controlled, repeatable manner that ensures correct alignment during barrel entry and provides uniform ballistic cycle characteristics. The central through-hole 14 of the endcap 12 may be profiled in a manner that controls the shot start force and barrel entry alignment. Shot start force may be a critical parameter influencing both the initial propellant pressure and projectile velocity build-up within the cartridge 100. Control of shot start via the endcap 12 interior profile may enable uniform initial ballistic characteristics. Transition of the projectile 20 from the endcap 12 into the barrel may be a prime factor influencing the down range dispersion of the projectile 20 after exiting the weapon barrel. The endcap 12 interior profile may incorporate features which facilitate alignment during the critical barrel entry transition, enabling subsequent accurate flight of the projectile 20 after barrel exit.

For example, as shown in FIGS. 4 and 9, the endcap 12 may include a predetermined diameter D and/or a stepped interface 34 to control the shot start force and increase the projectile accuracy of the cartridge 100. The stepped interface 34 may include one, two, three or more steps directed towards the through-hole 14. The diameter D may be adapted to tightly retain the projectile 20 prior to use, but also allow the projectile 20 to move in a forward direction F upon firing. The endcap 12 may include a substantially C-shaped portion 36 surrounding the circumference of the projectile 20 and contained within the case 10. The C-shaped portion 36 may be adapted to flex inwards during firing to seal against the projectile body to prevent gas leakage.

According to one embodiment, the projectile 20 may include a mounting groove 42 along its exterior surface (see FIGS. 4 and 9, where the mounting grooves 42 are enlarged for exemplary purposes only). The mounting groove 42 may face the interior surface of the endcap 12 located adjacent to the C-shaped portion 36. Ultrasonic welding may be used to affix the mounting groove 42 of the projectile 20 to the endcap 12 for component retention prior to and during use of the firearm. This may retain the projectile 20 in position under handling loads.

According to one embodiment, the endcap 12 may include an exterior seal 46, or film, to seal-off the through-hole 14 prior to firing. The exterior seal 46 may be constructed to exclude environmental contaminants from the cartridge 100 prior to use, but also to allow the projectile 20 to penetrate through the exterior seal 46 during firing. The exterior seal 46 may include an environmental seal and/or a bullet centering feature, such as, for example, an indent or groove to cradle the tip of the projectile 20.

As further shown in FIGS. 4 and 9, the case 10 and the endcap 12 may include a snap fit arrangement. For example, the case 10 may include a projecting portion 40 that may be adapted to fit into a recessed portion 38 of the endcap 12, thus, forming a snap fit 32. Relief volume 30 may be positioned between the projecting portion 40 and the recessed portion 38 of the snap fit 32 to assist in retaining a certain level of pressure within the cartridge 100 prior to firing.

As shown in FIG. 9, the endcap 12 may include a groove 44 along its exterior surface at a distance from the snap fit 32. The groove 44 may provide flex during firing of the firearm to increase diameter D of the endcap 12 to allow the projectile 20 to pass through the through-hole 14. The groove 44 may also be adapted to assist in positioning and retaining the ammunition cartridge 100 for feed conveyance, as in a linked ammunition belt (not shown).

According to one embodiment, the present invention may provide sealing at three different component interfaces of the cartridge 100 using an obturating type seal design that may be based on a principle of differential interior vs exterior pressure levels. This may provide reliable and dependable ballistic sealing of the cartridge 100.

According to another embodiment, an ultrasonic welding approach may be used to enable a polymer material to interface with a metallic component in a manner that precludes residual stresses and provides sufficient strength to withstand handling loads. This may provide steadfast component retention of the cartridge 100.

According to a further embodiment, the cartridge assembly may provide an endcap interior through-hole profile that may provide initial shot start and alignment control of the projectile while traversing the endcap prior to engaging the barrel rifling. This may provide consistent projectile launch control of the projectile 20 from the cartridge 100.

According to one embodiment, the design of a specialized component interface for a cased telescoped ammunition cartridge may provide sealing, component retention, and projectile launch control functions. These sub-elements may together comprise the cartridge assembly, and may: 1) preclude intrusion of environmental contamination; 2) prevent the escape of propellant gasses during ballistic operation; 3) retain components under handling loads; 4) provide alignment of projectile with the barrel during firing; and 5) provide repeatable ballistic functioning.

It will be understood that the above description of the present invention is susceptible to various modifications, changes and adaptations, and that the same are intended to be comprehended within the meaning and range of equivalents of the appended claims.

What is claimed is:

1. A telescoped ammunition cartridge assembly, comprising:

a case having a front end and a base end positioned along a longitudinal axis;

a projectile positioned along the longitudinal axis towards the front end of the case;

an endcap coupled to the front end of the case and adapted to retain the projectile entirely within the case;

a primer positioned along the longitudinal axis towards the base end of the case;

a primer support coupled to the base end of the case and adapted to support the primer within the case;

at least one obturating lip seal to seal at least one of the endcap or the primer support to the case; and a relief volume of air positioned between the case and at least one of the endcap or the primer support to maintain pressure within the case in the event propellant gasses escape during the initial stages of firing.

2. The telescoped ammunition cartridge assembly of claim 1, wherein the at least one obturating lip seal comprises an exterior surface exposed to propellant contained within the case, and an interior surface coupled to the at least one of the endcap or the primer support.

3. The telescoped ammunition cartridge assembly of claim 2, wherein the exterior surface has a larger surface area than the interior surface of the at least one obturating lip seal.

4. The telescoped ammunition cartridge assembly of claim 1, wherein the projectile includes a mounting groove adapted to face towards an inner surface of the endcap for removeable attachment of the projectile to the endcap.

5. The telescoped ammunition cartridge assembly of claim 4, wherein the mounting groove of the projectile is coupled to the endcap using an ultrasonic welding attachment.

6. The telescoped ammunition cartridge assembly of claim 1, wherein the endcap defines a through-hole having a diameter that is sized to receive and retain the projectile prior to firing.

7. The telescoped ammunition cartridge assembly of claim 6, wherein the endcap includes a stepped interface facing towards the through-hole to control shot start force and to increase firing accuracy.

8. The telescoped ammunition cartridge assembly of claim 6, wherein the endcap includes a C-shaped portion that is coupled to the projectile, wherein the C-shaped portion is adapted to flex inwards during firing to seal against the projectile body to prevent gas leakage.

9. The telescoped ammunition cartridge assembly of claim 6, further comprising a relief volume of air positioned within a snap fit and between the case and endcap to maintain pressure within the case in the event propellant gasses escape during the initial stages of firing.

10. The telescoped ammunition cartridge assembly of claim 1, wherein the primer support is coupled to the case using an ultrasonic welding attachment.

11. An ammunition cartridge assembly, comprising:

a case having a front end and a base end positioned along a longitudinal axis;

a projectile positioned along the longitudinal axis towards the front end of the case;

an endcap coupled to the front end of the case and adapted to retain the projectile at least partially within the case;

a primer positioned along the longitudinal axis towards the base end of the case;

a primer support coupled to the base end of the case and adapted to support the primer within the case;

a first obturating lip seal to seal the endcap to the case;

a second obturating lip seal to seal the primer support to the case; and a third obturating lip between the end cap and the projectile.

12. The ammunition cartridge assembly of claim 11, wherein at least one of the endcap or the primer support is coupled to the case using an ultrasonic welding attachment.

13. The ammunition cartridge assembly of claim 11, wherein the second obturating lip seal comprises an exterior surface exposed to propellant contained within the case, and an interior surface coupled to the primer support.

14. The ammunition cartridge assembly of claim 13, wherein the exterior surface has a larger surface area than the interior surface of the second obturating lip seal.

15. The ammunition cartridge assembly of claim 11, wherein the endcap defines a through-hole having a diameter that is sized to receive and retain the projectile prior to firing.

16. The ammunition cartridge assembly of claim 15, wherein the endcap includes a stepped interface facing towards the through-hole to control shot start force and to increase firing accuracy.

17. The ammunition cartridge assembly of claim 15, wherein the endcap includes a C-shaped portion that is coupled to the projectile, wherein the C-shaped portion is adapted to flex inwards during firing to seal against the projectile body to prevent gas leakage.

18. The ammunition cartridge assembly of claim 11, further comprising a relief volume of air positioned between the case and at least one of the endcap or the primer support to maintain pressure within the case in the event propellant gasses escape during the initial stages of firing.

19. A telescoped ammunition cartridge assembly, comprising:

a case having a front end and a base end positioned along a longitudinal axis;

a projectile positioned along the longitudinal axis towards the front end of the case;

an endcap coupled to the front end of the case and adapted to retain the projectile entirely within the case, wherein the endcap defines a through-hole having a diameter that is sized to receive and retain the projectile prior to firing and the end cap includes a stepped interface facing towards the through-hole to control shot start force and to increase firing accuracy;

a primer positioned along the longitudinal axis towards the base end of the case;

a primer support coupled to the base end of the case and adapted to support the primer within the case; and at least one obturating lip seal to seal at least one of the endcap or the primer support to the case.

20. An ammunition cartridge assembly, comprising:

a case having a front end and a base end positioned along a longitudinal axis;

a projectile positioned along the longitudinal axis towards the front end of the case;

an endcap coupled to the front end of the case and adapted to retain the projectile at least partially within the case, wherein the endcap defines a through-hole having a diameter that is sized to receive and retain the projectile prior to firing and the endcap includes a C-shaped portion that is coupled to the projectile, wherein the C-shaped portion is adapted to flex inwards during firing to seal against the projectile body to prevent gas leakage;

a primer positioned along the longitudinal axis towards the base end of the case;

a primer support coupled to the base end of the case and adapted to support the primer within the case;

a first obturating lip seal to seal the endcap to the case; and a second obturating lip seal to seal the primer support to the case.

* * * * *